United States Patent [19]

Kankaanpää

[11] 4,172,007

[45] Oct. 23, 1979

[54] METHOD AND APPARATUS FOR RELIABLY TRANSPORTING A WEB IN A PAPER MAKING MACHINE

[75] Inventor: Matti Kankaanpää, Espoo, Finland

[73] Assignee: Valmet Oy, Finland

[21] Appl. No.: 919,784

[22] Filed: Jun. 28, 1978

[30] Foreign Application Priority Data

Jul. 7, 1977 [FI] Finland ..... 772136

[51] Int. Cl.[2] ..... D21F 5/04

[52] U.S. Cl. ..... 162/206; 34/23; 34/25; 34/41; 34/115; 34/117; 162/359

[58] Field of Search ..... 162/206, 207, 193, 359, 162/290; 34/23, 25, 41, 115, 116, 117, 123, 159, 161

[56] References Cited

U.S. PATENT DOCUMENTS

| | | | |
|---|---|---|---|
| 1,122,281 | 12/1914 | Kilberry | 162/359 |
| 1,688,267 | 10/1928 | Cram | 162/193 |
| 2,091,805 | 8/1937 | Chuse | 162/206 X |
| 3,250,019 | 5/1966 | Beachler | 162/359 X |
| 3,956,832 | 5/1976 | Justus | 34/115 |
| 4,014,740 | 3/1977 | Koponen et al. | 162/193 X |

*Primary Examiner*—Richard V. Fisher

*Attorney, Agent, or Firm*—Steinberg & Blake

[57] ABSTRACT

A method and apparatus provided at the initial stages of the drying section in a paper making machine for reliably transporting the web from the press section to the drying section and for reliably transporting the web at the initial drying section stage including a group of drying cylinders including a pair of substantially horizontal rows of drying cylinders located one above the other defining an upper drying cylinder row and a lower drying cylinder row and a web supporting lower endless drying belt extending alternately between drying cylinders in said upper and lower drying cylinder rows alternately lapping sectors of the drying cylinders in the upper and lower rows. In its transport over these drying cylinders the web is separated from the drying cylinders in the upper cylinder row by the lower drying belt while the web is in contact with the drying cylinders in the lower cylinder row. An upper endless drying belt contacts the web portions which extend over the upper drying cylinders so that the web is located between the upper and lower drying belts over at least a portion of its travel over the upper drying cylinders. A selectively adjustable lead-in roller directs the upper drying belt into contact with a lead-in drying cylinder at least during the period when the web is directed from the press section to the drying section.

15 Claims, 1 Drawing Figure

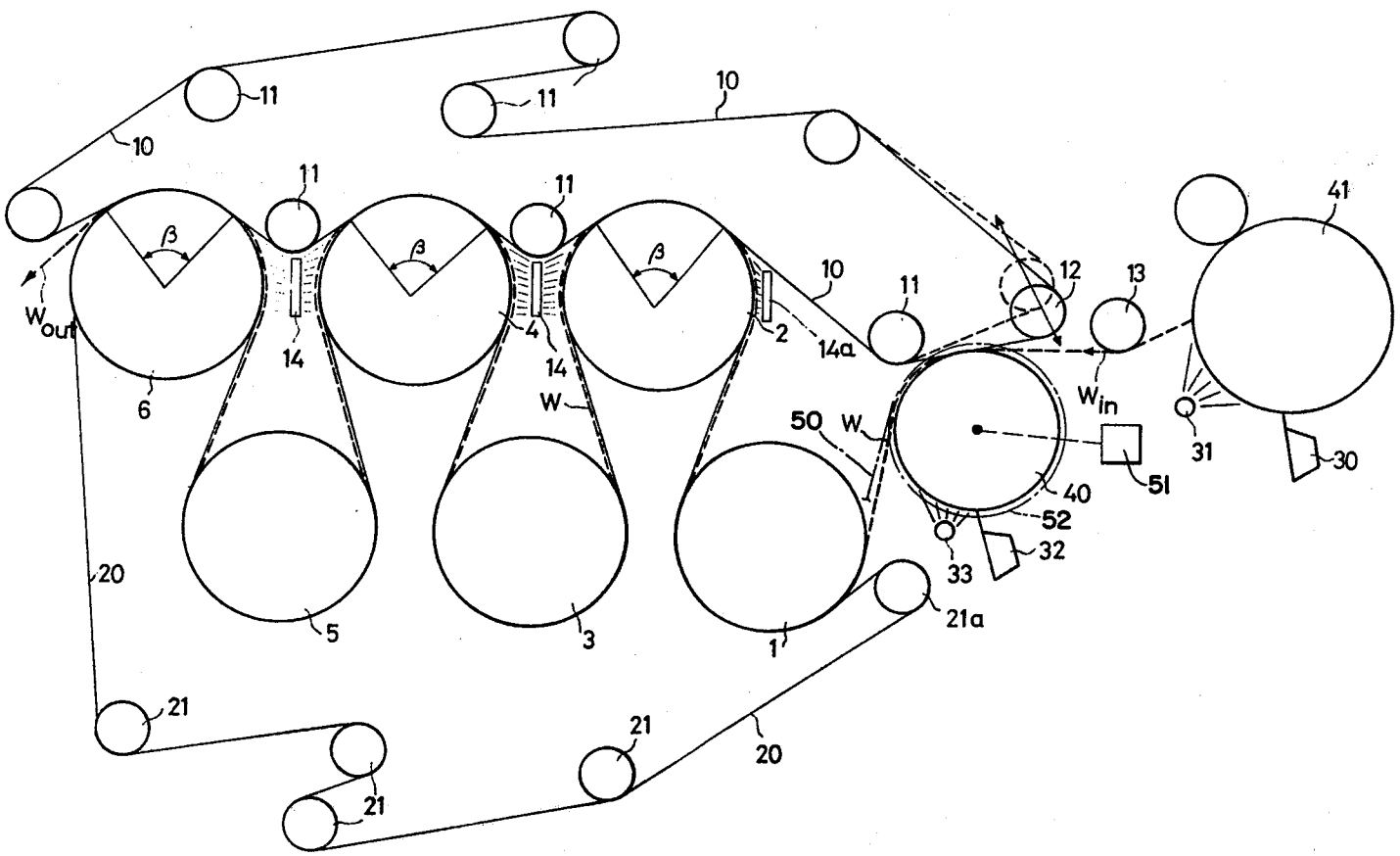
41
30
31
51
13
$W_{in}$
12
40
52
32
33
21a
11
W
50
10
14a
2
1
20
β
21
3
14
4
5
6
$W_{out}$

METHOD AND APPARATUS FOR RELIABLY TRANSPORTING A WEB IN A PAPER MAKING MACHINE

BACKGROUND OF THE INVENTION

This invention relates generally to paper making machines and, more particularly, to a method and apparatus for achieving reliable transport of a web from the press section to the initial stages of the drying section of a paper making machine.

Recently, paper making machines have been designed to operate at greater velocities and to produce webs of greater width then previous similar machines. Problems have become apparent in the operation of such new paper making machines, particularly at the initial stages of the drying section and, in particular, it has not been uncommon for a web to rupture during such operation, especially during the start up period of the machine. Such web ruptures have resulted in serious decreases in production efficiency. In order to overcome these problems, multiple cylinder drying sections have been under development which support the web with a drying wire or felt when the web is carried in the first cylinder group of the drying section. Typical examples of such multiple cylinder drying sections are disclosed in U.S. Pat. Nos. 3,874,997; 2,091,805; 3,503,139; and 3,576,078.

In U.S. Pat. No. 3,874,997, a multiple cylinder dryer section is disclosed wherein the web is carried in closed relationship and supported by a dryer fabric and in which both contact and flow through drying is accomplished by providing the drying cylinders of one cylinder row to be pervious to a dry gas stream and by locating special hoods close to these drying cylinders from which the drying gas stream is conducted through the web, the supporting wire and the perforated drying cylinder mantel.

U.S. Pat. No. 2,091,805 discloses a multiple drying cylinder section arranged to provide a closed or supported transport of the web in order to avoid free or unsupported draw. In the construction of the apparatus disclosed in this patent where the web travels over a zig-zag path from one drying cylinder row to another while supported by a wire, another row of suction transport cylinders equipped with pervious mantels is provided. In such embodiments, it is necessary to provide drying cylinders with pervious mantels and vacuum or overpressure chambers in at least one cylinder row. However, such drying cylinders equipped with pervious mantels and vacuum and overpressure equipment are relatively expensive.

U.S. Pat. No. 3,503,139 discloses a dryer section for a paper making machine including a multiple cylinder dryer which does not require the use of flow through cylinders of the type described hereinabove. In the structure disclosed in this patent, the web is transported from one row of the cylinder group to another while continuously supported by the wire. However, in such construction, the temperature of the upper cylinder row is usually higher than normal since in the use of such apparatus a wire or felt is located between the web and the surface of the drying cylinder. Thus, at high speeds, the paper web may not be reliably held on the outer surface of the felt.

Similarly, in U.S. Pat. No. 3,576,078, a multiple cylinder dryer section is disclosed having a pair of wires between which the web is transported over the entire drying cylinder section. Although in the apparatus disclosed therein, flowthrough cylinders are not required, the use of such apparatus has not been entirely satisfactory since the web must on both the upper and lower drying cylinders continuously run between two wires. This results in the disadvantage at the portion of web travel wherein the web is bent or the direction of travel changes, the velocity of the web enclosing wires differ causing rubbing and abrasion thereby impairing the quality of the web surface.

It has also been proposed to move a narrow belt located in the side area adjacent the drying cylinders onto the top of the web utilizing special equipment while the web passes over the upper row of drying cylinders.

SUMMARY OF THE INVENTION

Accordingly, it is one object of the present invention to provide a new and improved method and apparatus for reliably transporting a web in a paper making machine from the press section to the drying section.

Another object of the present invention is to provide new and improved apparatus for transporting the web in the initial stage of the drying section.

Still another object of the present invention is to provide such a method and apparatus for achieving closed transport of a web without the use of flowthrough cylinders, i.e. cylinders equipped with pervious mantels and vacuum or overpressure chambers.

Briefly, in accordance with these and other objects, a method and apparatus is provided including a group of drying cylinders including a pair of substantially horizontal rows of drying cylinders, one above the other defining an upper drying cylinder row and a lower drying cylinder row. A web supporting lower endless drying belt extends alternately between the upper and lower drying cylinders alternately lapping upper drying cylinders and lower drying cylinders. The web is transported on the lower belt such that it is separated from the upper drying cylinders by the lower belt while it contacts the drying cylinders in the lower cylinder row. In order to maintain the web in contact with the lower drying belt as it moves over the upper drying cylinders, an upper drying belt is provided which is directed over to press against the top of the web to urge the web against the lower drying belt on a sector which is smaller than the sector on which lower drying belt laps the upper cylinders. A lead-in drying cylinder is located between the above mentioned drying cylinders and the press section of the machine which is engaged by the upper drying belt to an extent determined by an adjustable lead-in roller. The web is directed around the lead-in drying cylinder by the upper endless belt at least during the initial startup of the paper machine to insure reliable transport of the web from the press section to the initial dryer section.

DESCRIPTION OF THE DRAWINGS

A more complete appreciation of the invention and many of the attendant advantages thereof will be readily appreciated as the same becomes better understood by reference to the following detailed description when considered in connection with the accompanying drawings wherein the FIGURE is a diagrammatic side view of the initial stage of the drying section of a paper machine in accordance with the method and apparatus of the present invention.

DESCRIPTION OF THE PREFERRED EMBODIMENTS

Referring now to the FIGURE illustrating a diagrammatic side view of the initial stage of a drying section of a paper machine in which the method and apparatus of the present invention is employed, a group of drying cylinders 1 through 6 are located in a pair of substantially horizontal rows defining an upper drying cylinder row including drying cylinders 2, 4, 6 and a lower drying cylinder row comprising drying cylinders 1, 3 and 5. The drying cylinders in the upper drying cylinder row are arranged imbricately with respect to the drying cylinders in the lower drying cylinder row, i.e., each drying cylinder in the lower cylinder row is located substantially below the space defined between two adjacent drying cylinders in the upper cylinder row. It is understood that although the present embodiment illustrates a group of six drying cylinders as described above, it is understood that the invention is not limited to this number but may include a group of such drying cylinders numbering preferably between three and eight.

A press roller 41 is shown from which the web W is directed towards the initial stage of the drying section as denoted by $W_{in}$.

A lead-in cylinder 40 having a diameter preferably smaller than that of drying cylinders 1–6 (but which may also have a diameter substantially the same as such drying cylinders) is provided between press cylinder 41 and the group of drying cylinders 1–6 and is vertically disposed substantially between the top and bottom rows of the drying cylinders.

According to the invention, a lower drying belt 20, such as a conventional drying felt or drying wire fabric guided along the lower portion of its run by guide rollers 21, 21*a*, extends alternately between the drying cylinders 2, 4, 6 in the upper cylinder row and the drying cylinders 1, 3, 5 in the lower cylinder row alternately lapping sectors of the drying cylinders in the upper row and sectors of the drying cylinders in the lower row.

It is clear that by the above described arrangement of lower endless belt 20 on the group of cylinders 1–6, that upon the paper or board web W being directed from lead-in roller 40 to lower drying cylinder 1 into the space defined between the surface of drying cylinder 1 and lower drying belt 20, that the web W will be continuously supported by belt 20 in a manner such that it will contact the surfaces of the lower drying cylinders 1, 3, 5 but will be separated from the surfaces of upper drying cylinders 2, 4, 6 by the lower drying belt 20.

Although this arrangement results in efficient drying of the web, the operational reliability of the machine suffers in that at high speeds of the paper machine, the web W tends to separate and lose contact with the drying belt 20 as it travels around the sectors of the upper drying rolls due to the action of centrifugal force. Although this tendency to separate does not inevitably result in rupture of the web, it causes stretching of the web to a certain degree which has an unfavorable effect on the strength of the finished paper.

It is one of the objects of the present invention to overcome this problem. To this end, the initial stage of the drying section defined by the group of drying cylinders 1–6 is provided with an upper endless drying belt 10 which is guided by guide rollers 11 such that portions of belt 10 contact against sectors of the drying cylinders 2, 4, 6 in the upper cylinder row thereby urging web W against the lower drying belt 20 at those locations on the upper drying cylinders at which the web W has a particular tendency to separate from the lower belt 20. It is seen, however, that upper belt 10 overlies the web W on the upper drying cylinders over a relatively small sector, designated $\beta$, in order to assure that the loss of evaporation due to the overlying relationship of upper belt 10 over web W, is minimized. Similarly, in order to minimize the tendency of upper belt 10 to prevent evaporation, the upper belt 10 is preferably formed of a loose fabric structure of a high permeability. The provision of a small contact sector $\beta$ also diminishes the rubbing which exists between the web W and the upper and lower drying belt 10, 20. It is understood that the extent and location of sector $\beta$ is determined experimentally and that in some cases, the sector may be unsymmetrical with respect to the vertical plane passing through the axes of drying cylinders 2, 4, 6.

In addition to preventing separation of web W from the lower drying belt 20 on upper drying cylinders 2, 4, 6, upper belt 10 additionally serves to promote the reliable transport of the web from the press section of the paper making machine to the drying section. Thus, a position adjustable guide roller 12 cooperates with another guide roller 11 to provide a portion of travel of upper belt 10 which contacts and is urged against the surface of lead-in cylinder 40. Thus, especially during the initial startup of the paper machine, when the web W is carried from the press section, i.e. press roll 41 to the drying section, where difficulties have been found to exist in connection with high velocity paper machines, the web coming from press roller 41 is securely held on the surface of lead-in cylinder 40 by upper belt 10. A lead-in roller 13, whose position can be adjusted vertically is provided to facilitate the removal of the web from the surface of the press roller 41.

The conventionally occurring edge strip on the web is removed from the press roller 41 in the usual manner by means of a scraper 30 and conventional blowing equipment 31 so that web W may easily be directed to the gap defined between upper belt 10 and the lead-in cylinder 40. The web, being damp, tends to stick on the surface of lead-in cylinder 40 and is removed therefrom in the same way as in the case of press roller 41, i.e., with scraper 32 and blower 33 so that web W can be fed into the space defined between lower drying cylinder 1 and lower belt 20. This insures the reliable transport of web W through the initial stage of the dryer section, i.e., through cylinders 1–6.

It is understood that after the initial startup of the machine whereupon the full width of web W is carried from press roller 41 over lead-in cylinder 40 to the gap between lower belt 20 and cylinder 1, and after the tension in the web between the lead-in roller and the cylinders is stabilized, the roller 12 may be raised to the upper position shown in broken lines in the FIGURE thereby lifting the upper belt from contact with lead-in roller 40.

In order to further insure that web W does not separate from lower belt 20 during its travel to, on and from upper cylinders 2, 4, 6, blower apparatus 14 are provided between upper drying cylinders 2, 4, 6 which direct jets of air and pressure onto web W towards belt 20 thereby preventing web W from separating from belt 20 due to centrifugal forces and, thereby, prevent consequent rupture of the web. Additionally, the blowing apparatus serves to facilitate the evaporation of water from the web. It is seen that whereas blowers 14 each direct jets against two adjacent paths of travel of web W, blowing apparatus 14a, situated adjacent drying cylinder 2, only provides a single sided blowing onto the web.

As mentioned hereinabove, the fact that the sectors $\beta$ on upper drying cylinders 2, 4, 6 are relatively small results in a remarkably improved drying effect, not only by preventing evaporation over a relatively minimal portion of the web, but also by providing portions of travel of the web which may be treated by the air blowing treatment provided by apparatus 14, 14a. It has been found that the extent of sector $\beta$ is preferably between 60° and 150° and, where known fabrics are used in upper belt 10, preferably 100°.

Referring to the take off of the web from press roll 41 and its direction over lead-in roller 40 to a space between drying cylinder 1 and bottom web 20, in some cases it has been found that by providing the guide roller 12 with suction chambers, roller 13 may be omitted entirely. Of course, in such cases, the upper belt 10 contacts the web on the surface of lead-in roller 40.

The construction of the present invention assures reliable transport of the web and, additionally, permits appropriate superimposition on the web when the superimposing belt extends over the full width of the web. Thus, conventional cable superimposing apparatus comprising a cable 50, schematically illustrated by a dash-dot line, and a cable ring 52, also schematically illustrated by a dash-dot line, can be operatively associated with the group of drying cylinders 1–6. Of course, the cable 50 follows at least a portion of the path of the web. The drying cylinders are equipped with grooves (not shown) for the cable, well known to those skilled in the art. Further, lead-in cylinder 40 is provided with a freely rotating cable ring 52, rotatably mounted on the same axis of rotation as lead-in cylinder 40. By this construction, since the speed of the cable is determined by the speed of rotation of drying cylinders 1–6, the extent of the tension of web W required by the superimposition can be adjusted by adjusting the speed of lead-in cylinder 40. Of course, conventional apparatus for adjusting the speed of the lead-in cylinder independently of the speed of the drying cylinders, schematically illustrated at 51, is provided in this case.

Obviously, numerous modifications and variations of the present invention are possible in the light of the above teachings. Accordingly, the scope of the invention is determined solely by the following claims.

What is claimed is:

1. Apparatus for reliably transporting a web in a paper making machine from a press section to a drying section and for transporting the web at the initial stage of the drying section, comprising:

a group of drying cylinders including a pair of substantially horizontal rows of drying cylinders, said pair of horizontal drying cylinder rows being vertically spaced from each other defining an upper drying cylinder row and a lower drying cylinder row;

a web-supporting lower endless drying belt extending alternately between drying cylinders in said upper cylinder row and drying cylinders in said lower cylinder row, such drying belt alternately lapping first sectors of said drying cylinders in said upper row and sectors of said drying cylinders in said lower row, wherein the web is separated from the drying cylinders in said upper cylinder row by said lower drying belt and the web is in contact with the drying cylinders in said lower cylinder row;

an upper endless drying belt having a width substantially the same as the width of the web, said upper belt lapping second sectors of said drying cylinders in said upper row such that the web is located between said upper and lower drying belts within said second sectors, said second sectors being smaller than said first sectors of the drying cylinders in said upper row lapped by said lower drying belt;

a lead-in drying cylinder located between the press section and said group of drying cylinders; and a selectively adjustable lead-in roller means for directing said upper drying belt into contact with said lead-in drying cylinder at least during the period when the web is directed from the press section to the drying section.

2. Apparatus as recited in claim 1 further including means for adjusting the speed of said lead-in drying cylinder independently of the speed of said drying cylinders comprising said group of drying cylinders.

3. Apparatus as recited in claim 1 further including a cable control means for the drying section and a freely rotatable ring associated with said lead-in cylinder for said cable control means.

4. Apparatus as recited in claim 1 further including a press roller from which the web is transported to said lead-in cylinder and means for adjusting the tension on the web between said press roller and said lead-in cylinder.

5. Apparatus as recited in claim 1 further including means for adjusting the tension of the web between said lead-in cylinder and the first cylinder of said cylinder group to which said web is directed.

6. Apparatus as recited in claim 1 further including means located between the drying cylinders of said upper cylinder row for applying an air jet to the web whereby separation of the web from said lower drying belt is prevented.

7. Apparatus as recited in claim 1 wherein said second sectors each are in the range of 60° to 150°.

8. Apparatus as recited in claim 1 wherein said second sectors are each approximately 100°.

9. A method for reliably transporting a web in a paper making machine from a press section to a drying section and for transporting the web at the initial stage of the drying section wherein the drying section comprises at least a group of drying cylinders including a pair of substantially horizontal rows of drying cylinders, said pair of horizontal drying cylinder rows being vertically spaced from each other defining an upper drying cylinder row and a lower drying cylinder row and a lead-in drying cylinder located between the press section and said group of drying cylinders, comprising the steps of:

directing a web-supporting lower endless drying belt to extend alternately between drying cylinders in said upper cylinder row and drying cylinders in said lower cylinder row such that said drying belt alternately laps first sectors of said drying cylinders in said upper row and sectors of said drying cylinders in said lower row;

directing the web from said lead-in drying cylinder onto a first one of said group of drying cylinders such that during drying the web is separated from the drying cylinders in said upper cylinder row by said lower drying belt and is in contact with the drying cylinders in said lower cylinder row;

directing an upper endless drying belt having a width substantially the same as the width of the web into engagement with the web over a second sector on each of said drying cylinders in said upper row such that the web is located between said upper and lower drying belts over said second sectors, said second sectors being smaller than said first sectors of said drying cylinders in said upper roll lapped by said lower drying belt; and urging said upper drying belt into contact with said lead-in drying cylinder at least during the period when the web is directed from the press section to the drying section by selectively adjusting the position of a lead-in roller means.

10. A method as recited in claim 9 further including the step of selectively adjusting the circumferential speed of said lead-in cylinder independently of the circumferential speed of each of said group of drying cylinders.

11. A method as recited in claim 9 further including the step of selectively adjusting the tension of the web between a last roller of the press section and said lead-in drying cylinder by adjusting the circumferential speed of said lead-in drying cylinder.

12. A method as recited in claim 9 further including the step of selectively adjusting the tension of the web between said lead-in drying cylinder and the first cylinder of said group of cylinders to which said web is transported.

13. A method as recited in claim 9 further including the step of directing an air jet onto the drying cylinder in said upper cylinder row so that separation of the web from the lower drying belt is prevented.

14. A method as recited in claim 9 wherein said second sectors are each in the range of 60° to 150°.

15. A method as recited in claim 9 wherein the second sectors are each approximately 100°.

* * * * *